US008062531B1

(12) United States Patent
LoBello

(10) Patent No.: US 8,062,531 B1
(45) Date of Patent: Nov. 22, 2011

(54) UNDERGROUND STORMWATER MANAGEMENT SYSTEM AND METHOD

(75) Inventor: Edward H. LoBello, Blacksburg, VA (US)

(73) Assignee: Lane Enterprises, Inc., Camp Hill, PA (US)

( * ) Notice: Subject to any disclaimer, the term of this patent is extended or adjusted under 35 U.S.C. 154(b) by 106 days.

(21) Appl. No.: 12/512,271

(22) Filed: Jul. 30, 2009

Related U.S. Application Data

(60) Provisional application No. 61/085,062, filed on Jul. 31, 2008.

(51) Int. Cl.
*E03F 5/14* (2006.01)

(52) U.S. Cl. ..... 210/747.2; 210/800; 210/804; 210/170.03; 210/254; 210/257.1; 210/299; 210/532.1; 405/40; 405/51; 405/52

(58) Field of Classification Search ..... 210/170.03, 210/254, 257.1, 299, 532.1, 747, 800, 804; 405/36, 40, 41, 51, 52
See application file for complete search history.

(56) References Cited

U.S. PATENT DOCUMENTS 1,793,599 A * 2/1931 Egan ..... 210/170.03
5,249,887 A 10/1993 Phillips
5,266,191 A * 11/1993 Greene et al. ..... 210/257.1
5,419,838 A 5/1995 DiTullo
5,433,845 A 7/1995 Greene et al.
5,810,510 A 9/1998 Urriola
6,126,817 A * 10/2000 Duran et al. ..... 210/532.1
6,264,835 B1 7/2001 Pank
6,361,248 B1 3/2002 Maestro
6,638,424 B2 10/2003 Stever et al.
6,991,734 B1 1/2006 Smith et al.
7,022,243 B2 4/2006 Bryant
7,048,849 B2 5/2006 Wade
7,182,856 B2 2/2007 Pank
7,186,058 B2 3/2007 Schluter et al.
7,425,262 B1 * 9/2008 Kent ..... 210/170.03
7,540,954 B2 * 6/2009 An et al. ..... 210/170.03
2005/0103698 A1 * 5/2005 Eberly ..... 210/254
2009/0050583 A1 * 2/2009 Arnott et al. ..... 210/170.03
2009/0200216 A1 * 8/2009 Robinson et al. ..... 210/254
2010/0059430 A1 * 3/2010 Adams et al. ..... 210/170.03

* cited by examiner

*Primary Examiner* — Christopher Upton
(74) *Attorney, Agent, or Firm* — Hooker & Habib, P.C.

(57) ABSTRACT

An underground stormwater management system includes a receiving tank connected to a source of non-first flush runoff and a storage chamber that accumulates stormwater runoff for discharge to a storm drain. The storage chamber includes a first inlet connected to a source of first flush runoff, a second inlet connected to receive overflow from the receiving tank, a first discharge and a second discharge above the first discharge. First flush is discharged from the first discharge and is filtered before reaching the storm drain. The receiving tank assists in delaying the receipt of non-first flush runoff into the storage chamber during a major rain event. During major rain events runoff is also discharged from the storage chamber directly to the surrounding media.

28 Claims, 7 Drawing Sheets

UNDERGROUND STORMWATER MANAGEMENT SYSTEM AND METHOD

This application claims priority to my U.S. Provisional Patent Application No. 61/085,062 filed Jul. 31, 2008.

FIELD OF THE INVENTION

The invention relates generally to stormwater treatment, and particularly to an underground stormwater management system and method for receiving and discharging stormwater runoff to a storm drain.

BACKGROUND OF THE INVENTION

Stormwater runoff includes the initial runoff or "first flush" that contains sediments, oil, and other pollutants flushed from surface areas, and other runoff that can be considered essentially pollution-free. The pollution-free runoff includes the later runoff from the surface areas that generated the first flush, and runoff from areas without surface pollutants. In major storm events the volume of non-first flush is substantially greater than the volume of first flush.

Stormwater treatment systems have been developed to remove pollutants from the first flush. Conventional first flush treatment systems include systems that pass the first flush through a filter to remove pollutants. The filter can be a relatively inexpensive low-head filter because of the relatively low volume and flow of runoff to be filtered.

Underground stormwater management systems have also been developed that receive runoff at a high rate during a major storm event, and discharge the runoff at a lower rate to a storm drain. Such systems include an underground storage chamber that receives and stores the water that accumulates while the flow into the storage chamber is greater than the discharge out. The water discharges at a relatively high head from the storage chamber to enable discharge near the maximum discharge rate allowed by applicable law or regulation. The discharge is normally not filtered, but if filtering is desired an expensive high-head filter must be used because of the high volume and flow of runoff being filtered.

Sites such as shopping centers, business parks, and other developed areas often use separate stormwater treatment systems and underground stormwater management systems. The stormwater treatment system is connected to surface areas that generate relatively low volume first flush, while the underground stormwater management system is capable of receiving and accumulating a large volume of non-first flush runoff from major storm events. Building and maintaining two stormwater systems is expensive and can be difficult to locate on some sites.

Thus there is a need for an improved underground storage system that can receive both receives and filters first flush and stores and accumulates large amounts of non-first flush runoff during major storm events without the need for an expensive, high-head filter.

SUMMARY OF THE INVENTION

The invention is an improved underground stormwater management system that receives and filters first flush and stores and accumulates large volumes of runoff without using an expensive high-head filter.

The underground stormwater management system in accordance with the present invention manages the flow of runoff to a stormwater drain. The system includes a storage chamber defining an interior for receiving and discharging runoff, a filter outside of the storage chamber, a first discharge line to flow runoff from the storage chamber to the stormwater drain, and a second discharge line to flow runoff from the storage chamber to the stormwater drain.

The storage chamber includes an inlet to receive runoff into the interior of the storage chamber, a first discharge outlet to discharge runoff from the interior of the storage chamber into the first discharge line, and a second discharge outlet to discharge runoff from the interior of the storage volume into the second discharge line.

The first outlet is at a first elevation and the second outlet is at a second, higher elevation than the first outlet, the first elevation corresponding to a first volume of runoff in the interior of the storage chamber and the second elevation corresponding to a second, greater volume of runoff in the interior of the storage chamber. The storage chamber must fill to at least the greater volume before reaching the second outlet. The filter is in the first discharge line to filter runoff flowing through the first outlet line.

During a storm event first flush is received into the storage chamber. The first flush is discharged through the first discharge opening while the water level in the storage chamber is below the second discharge opening. The filter filters the first flush before the first flush reaches the storm drain.

Non-first flush is received in the storage chamber after the storage chamber began receiving the first flush. The flow of non-first flush may be sufficient to raise the water level in the storage chamber above the second discharge opening. Runoff in the storage chamber is discharged simultaneously through the first and second discharge openings while the water level in the storage chamber is at or above the second discharge opening, the discharge through the second discharge opening preferably not being filtered.

The underground stormwater management system takes advantage of first flush arriving at the storage chamber before the non-first flush. The delay in arrival of the non-first flush enables the first flush to be received into the storage chamber and to begin being discharged through the filter before the receipt of the non-first flush. Because of the relatively large volume of the storage chamber and the relatively small volume of first flush, an inexpensive low-head filter can be used in the first discharge line.

In a preferred embodiment of the invention the storage chamber is fluidly connected to a receiving tank that receives the non-first flush. The receiving tank includes a discharge that discharges to the second discharge line. Overflow from the receiving tank flows into the storm chamber. The time needed to overflow the receiving tank adds to the delay between receipt of first flush and the receipt of non-first flush in the storage chamber. The receiving tank is preferably sized such that in many rain events the receiving tank does not overflow, and none of the non-first flush flows into the storage chamber.

During a severe rain event, the receiving tank must overflow before discharging to the storage chamber. The additional delay needed for the receiving tank to fill to overflowing provides additional time for the first flush to discharge from the storage chamber before the storage chamber receives runoff from the receiving tank. Preferably the receiving tank is sized to permit all the first flush to be discharged from the storage chamber before the receiving tank overflows.

The storage chamber in some embodiments includes a perforated storage section or portion that enables runoff in the perforated storage portion to discharge directly into surrounding permeable media. This enables the surrounding media to increase the effective storage capacity of the system.

The perforated storage portion may be configured or arranged such that the water level in the storage chamber must exceed a predetermined minimum elevation before runoff flows into the perforated storage portion. The storage chamber is preferably sized such that first flush does not reach the water level necessary for substantial flow into the perforated storage portion so that no first flush, or essentially no first flush, is discharged through the perforated storage portion into the surrounding media.

The underground stormwater management system of the present invention is capable of both treating first flush and storing and accumulating a large volume of runoff using the same storage chamber. There is no need for separate stormwater treatment and stormwater management systems, thereby reducing cost and making more efficient use of the site in managing stormwater runoff.

Other objects and features of the present invention will become apparent as the description proceeds, especially when taken in conjunction with the accompanying seven drawing sheets illustrating three embodiments of the invention.

DESCRIPTION OF THE PREFERRED EMBODIMENTS

Figure 1:
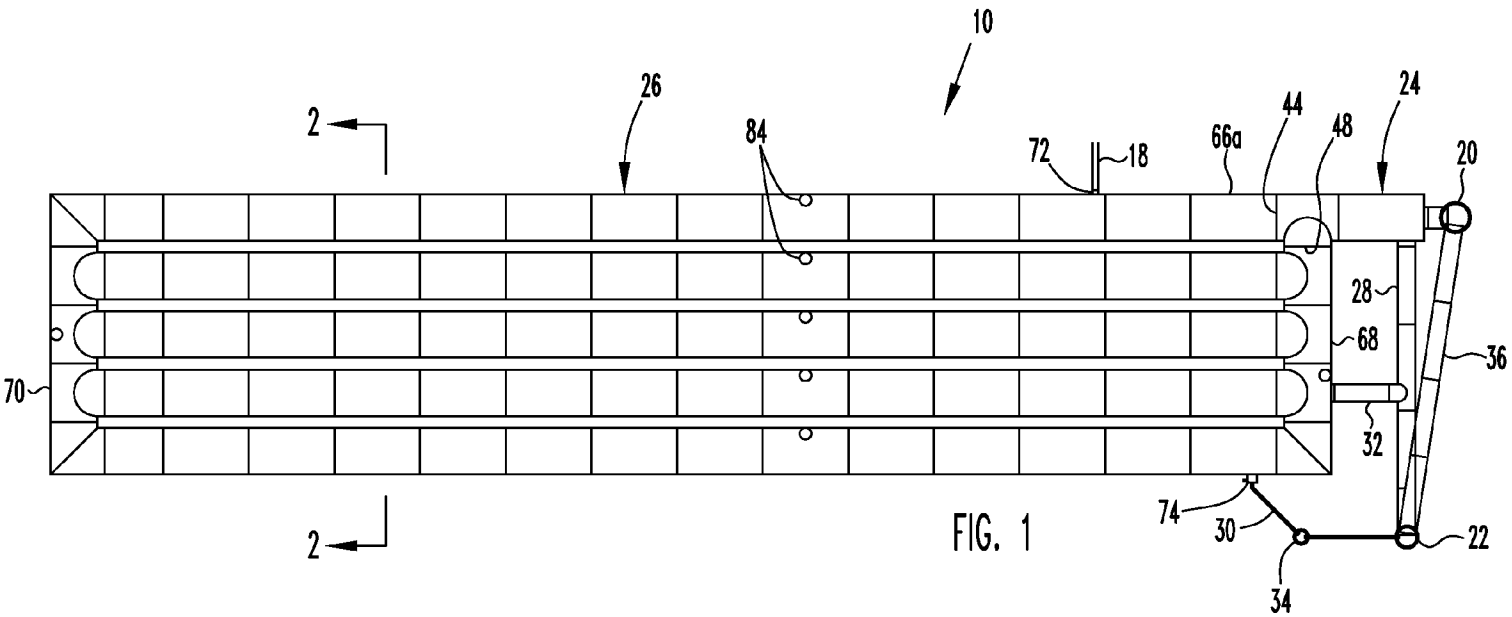
FIG. 1 is a top view of an underground stormwater management system (USMS) in accordance with the present invention.
Figure 2:
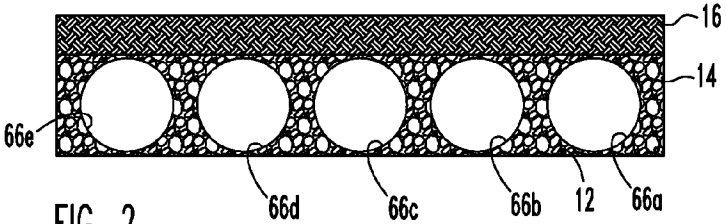
FIG. 2 is a sectional view taken along lines 2-2 of FIG. 1, the USMS buried below grade.
Figure 4:
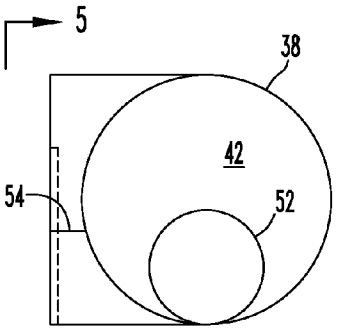
FIG. 4 is a side view of the receiving tank taken along lines 4-4 of FIG. 3.
Figure 6:
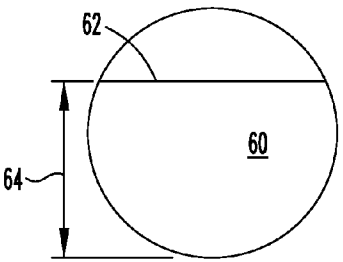
FIG. 6 is a side view of the body of the receiving tank taken along lines 6-6 of FIG. 3.
Figure 3:
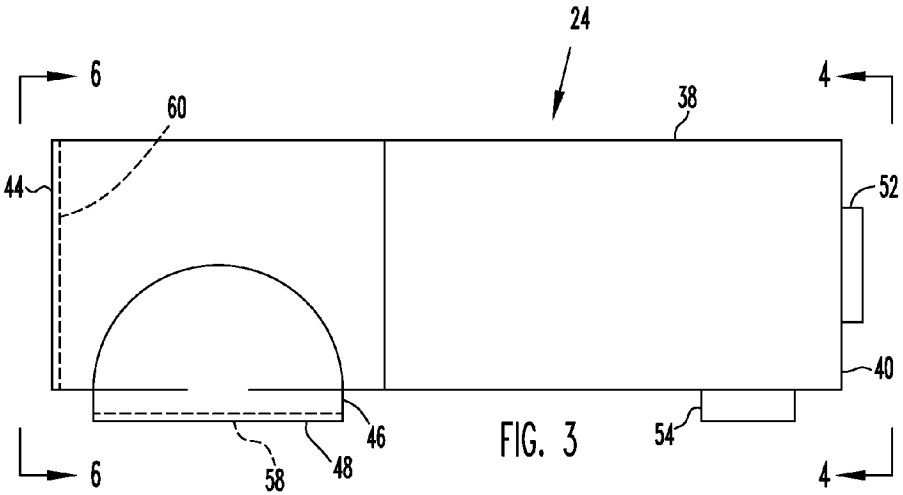
FIG. 3 is a top view of the receiving tank of the USMS shown in FIG. 1.
Figure 5:
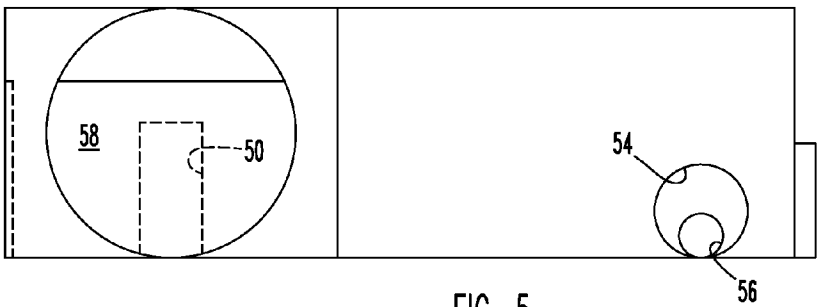
FIG. 5 is a front view of the receiving tank taken along lines 5-5 of FIG. 4.

FIGS. 1 and 2 illustrate an underground stormwater management system (USMS) 10 in accordance with the present invention. Illustrated USMS 10 is formed primarily from lengths of twelve-foot diameter corrugated aluminized pipe. USMS 10 is buried in a trench 12 below field grade. The trench is backfilled with a permeable media 14, the permeable media 14 surrounding the USMS 10. A suitable permeable media is clean #57 open graded stone backfill or equivalent. The remainder of the trench is filled with a non-permeable media 16 to grade level, and the entire trench is preferably wrapped in a nonwoven filter fabric.

Illustrated USMS 10 receives runoff water from a first incoming storm drain 18 and a second incoming storm drain 20, and discharges water to an outgoing storm drain 22 that carries the water off site.

USMS 10 includes an inlet tank or receiving tank 24 that receives and accumulates runoff from a relatively small diameter storm drain 18, and a storage chamber 26 that receives and accumulates runoff from a relatively large diameter storm drain 20. The receiving tank 24 discharges water through a main discharge pipe 28 extending from the inlet tank 20 to the storm drain 18. During a major storm event the receiving tank 24 also discharges overflow into the storage chamber 26 as will be explained in more detail later below.

Storage chamber 26 discharges water through a first discharge pipe 30 and a second discharge pipe 32. Discharge pipe 30 extends from the storage chamber 26 to the storm drain 22, and slopes downwardly to an inline filter 34. Discharge pipe 32 extends from the storage chamber 26 and discharges into the main discharge pipe 28 downstream from the inlet tank 24.

Filter 34 removes pollutants and sediment from water flowing through pipe 30 prior to the water reaching the storm drain 22. Suitable filters are commercially available and known in the art, and so the filter 34 will not be described in detail.

A bypass pipe 36 extends from the second incoming storm drain 20 to the discharge storm drain 22 and permits runoff to fully or partially bypass the USMS 10 in the event of rare storm events or obstructions.

FIGS. 3-6 illustrate receiving tank 24 separate from the remainder of USMS 10. Receiving tank 24 includes a tubular body 38 having a first end 40 closed by a bulkhead 42 and an opposite open end 44. A right-angle tubular extension 46 extends from the body to an open end 48. An opening 50 in the body 38 communicates the interior of the body with the interior of the extension. An inlet pipe stub 52 extends through the bulkhead 42 to flow water from the inlet drain 20 into the receiving tank 24. An outlet pipe stub 54 located near the bottom of the body 38 attaches to the end of the main discharge pipe 28. A reduced-diameter discharge opening or discharge orifice 54 formed in the body wall at the bottom of the pipe stub 52 discharges water out of the receiving tank 24 into the discharge pipe 28.

The open ends pipe ends 44, 48 are each partially closed by respective weirs. Each weir is defined by a respective metal plate 58, 60 that closes all but an upper portion of the pipe end. Each weir plate 58, 60 has an upper end 62 spaced a predetermined elevation 64 above the bottom of the receiving tank 24. The elevation of the upper ends of the weir plates defines the maximum interior storage volume of the receiving tank 24 without water spilling over the weir plates.

Referring back to FIGS. 1 and 2, the storage chamber 26 includes a horizontal array of tubular storage tanks 66 connected by front and rear storage tanks 68, 70. Front storage tank 68 extends parallel with the main discharge pipe 28. The illustrated storage array includes tanks 66*a*, 66*b*, 66*c*, 66*d*, and 66*e* spaced apart from one another and arranged in parallel. The storage tanks 66, 68, 70 are each at the same elevation.

The storage chamber 26 is fluidly connected to the receiving tank 24. One end of storage tank 66*a* is connected to the end 44 of the receiving tank. One end of the front storage tank 68 is attached to the other end 48 of the receiving tank. Weir plates 58, 60 separate the interior of the receiving tank 24 from the interior of the storage chamber 26.

Figure 8:
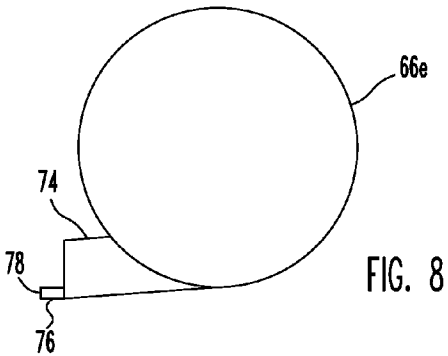
FIG. 8 is an end view of another storage tank of the USMS shown in FIG. 1.
Figure 7:
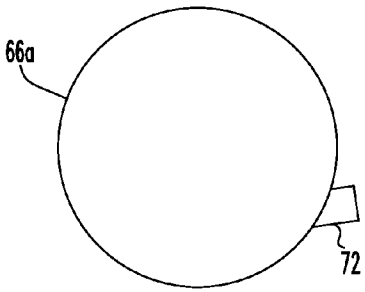
FIG. 7 is an end view of a storage tank of the USMS shown in FIG. 1.

An inlet pipe stub 72 defining an inlet opening extends into the storage tank 66*a* and connects the storage chamber 26 with the first incoming storm drain 18. See also FIG. 7. An outlet pipe stub 74 extends downwardly from near the bottom storage tank 66*e* to below the storage tank 66*e*, connecting the storage chamber 26 with the first discharge pipe 30. See also FIG. 8. As shown in FIG. 8 a reduced-diameter pipe 76 defines a discharge opening or discharge orifice 78 that discharges water out of the storage tank and into the first discharge pipe 30. The discharge opening 78 defines the lowest elevation of the storage chamber 26 such that the opening 78 can drain the storage chamber 26.

Figure 10:
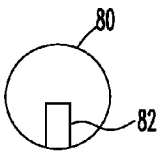
FIG. 10 is a view of the discharge orifice in the front storage tank shown in FIG. 9.

An outlet pipe stub 80 extends outwardly from the front storage tank 68 towards the main discharge line, connecting the storage tank 26 with the second discharge pipe 32. See FIG. 9. A discharge opening 82 (see FIG. 10) formed in the wall of the storage tank 68 defines a discharge opening or discharge orifice that that is significantly larger than the discharge opening 78. The discharge opening 82 is higher in elevation than the discharge opening 78.

Each storage tank 66, 68, 70 is formed from the aluminized corrugated pipe referred to above. Storage tanks 66*a*, 66*b*, 66*d*, and 66*e*, and front and rear storage tanks 68, 70 are formed from solid pipe, that is, pipe having solid, non-perforated walls. The solid walls prevent direct fluid communication between water in the pipe and the surrounding media 14. These storage tanks with solid walls define a solid storage portion of the storage chamber 24.

Storage tank 66*c* is formed from perforated pipe, that is, pipe having apertures or holes extending through the pipe walls. The perforated pipe enables direct fluid communication between water in the pipe and the surrounding media 14, allowing water to discharge directly from the storage tank 66*c* into the permeable medium 14. Storage tank 66*c* defines a perforated storage portion of the storage chamber 26.

Figure 9:
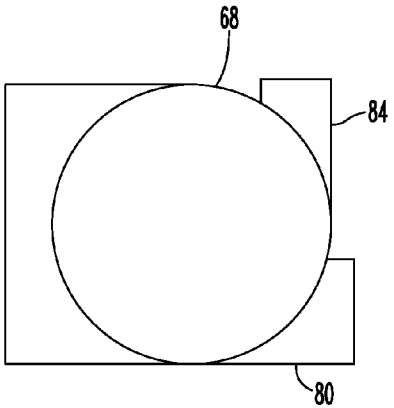
FIG. 9 is an end view of the front storage tank of the USMS shown in FIG. 1.

Vertical cleanout or access risers 84 can also be provided for access to the USMS 10 after installation (see FIGS. 1 and 9).

Figure 11:
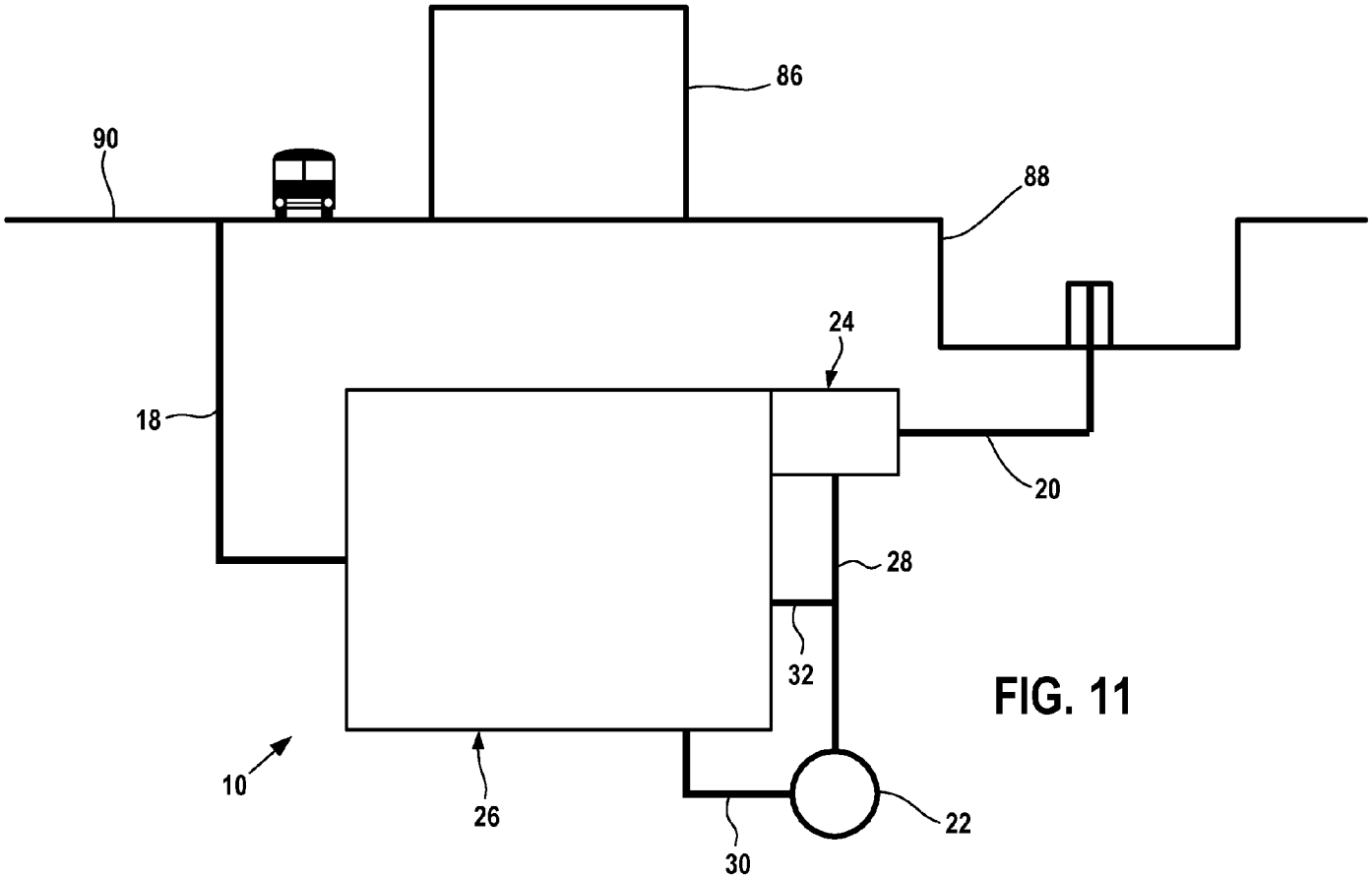
FIG. 11 is a representational view of the USMS shown in FIG. 1 installed at a site of a shopping center site to manage stormwater runoff at the site.

The operation of USMS 10 will now be described with respect to storm events of increasing severity. For the non-limiting purpose of illustration it is assumed USMS 10 manages stormwater runoff at a shopping center 86 that has a detention basin 88 and includes a parking lot 90. See FIG. 11. The detention basin 88 is connected to the USMS 10 by the storm drain 20, and the storm drains of the parking lot 90 are connected to the USMS 10 by the storm drain 18 as illustrated in FIG. 11.

The detention basin 88 discharges non-first-flush water, that is, the runoff stored in the detention basin 88 can be considered substantially free of contaminants and pollutants. The runoff received in the detention basin 88 can be either on-site or off-site runoff.

The parking lot 90 is a source of first flush. For purposes of discussion it is assumed that the first flush is generated from the first half-inch of rainfall, and that runoff from the parking lot after the first half-inch of rainfall can be considered non-flush runoff essentially free of contaminants and pollutants. It is also assumed for illustration that flow from the detention basin 88 occurs after an inch of rain has fallen.

The first example storm event is a storm event that is a half-inch or less. The USMS 10 receives runoff only from the parking lot 90, and begins receiving runoff essentially at the start of the rain event. The parking lot runoff flows through inlet storm drain and flows directly into the storage chamber 26 of USMS 10 through inlet 74. The runoff received into the storage chamber 26 is entirely first flush. The relatively large volume of the storage chamber 26 is sufficient to prevent the water level in the storage chamber 26 from reaching the elevation of the second discharge outlet 82.

The first-flush received from the parking lot 90 is discharged solely through the first discharge line 30 and is filtered by the filter 34 before reaching the storm drain 22. The relatively low water level in the storage tank and the relatively small discharge opening 78 causes flow through the discharge line 30 at a relatively low head, permitting the use of a low-head filter for filter 34.

In the illustrated embodiment the volume of the pipe stub 74 and the volume of the discharge pipe 30 from the pipe stub 74 to the filter 34 is sufficient to store essentially all the first flush. This enables the first flush to be discharged from the discharge outlet 78 at about the same rate as the flow of first flush into inlet 72 and minimizes the water level in the storage chamber 26. Because of the low water level little or no first flush flows into the perforated storage tank 66*c*.

In a second rain event, the storm event exceeds one-half inch but does not exceed one inch. The USMS 10 receives runoff only from the parking lot 90. Like the first rain event, the relatively large volume of the storage chamber 26 is sufficient to prevent the water level in the storage chamber 26 from reaching the elevation of the second discharge outlet 82. The first flush and the runoff received after the first flush is discharged at relatively low head through the discharge line 30 and is filtered before reaching storm drain 22 as previously described.

In a third, more severe rain event, the rainfall exceeds one inch. This is sufficient to generate flow from the detention basin 88. During the first inch of rainfall, the USMS 10 receives runoff only from the parking lot 90. The first flush discharges through the discharge pipe 30 and is filtered by filter 34 as previously described.

Initial receipt of runoff from the detention basin 88 does not occur at the start of the rain event, but is delayed for the time needed for the detention basin to fill and begin discharging runoff.

The runoff from the detention basin 88 flows via drain 20 into the receiving tank 24 and is discharged through the receiving tank discharge opening 56 to the main discharge pipe 28. As the water level in the receiving tank 24 increases, the hydraulic head at the discharge opening 56 increases and the flow into the discharge pipe 28 increases. The size and shape of the discharge opening, and the rate of change in water level, can be designed to meet the discharge needs of the site. The storm event is not severe enough to cause the water in the receiving tank 26 to flow over the weirs 58, 60, and so none of the runoff from the detention basin 88 flows into the storage chamber 26.

Storage chamber 26 does continue to receive runoff from the parking lot 90 in parallel with the receipt of runoff into the receiving tank 24, and continues to discharge low head flow through the discharge pipe 30.

If the water level in storage chamber 26 reaches the second discharge opening 82, the increased water level generates additional discharge through the main discharge pipe 28. This additional discharge from the storage chamber 26 is not first flush, and flows directly through the main discharge pipe 28 without being filtered before discharging into the storm drain 22. The relatively small first discharge opening 78 and relatively small diameter discharge pipe 30 ensures low head flow through the filter 34 despite the increase in water level in the storage chamber 26.

In a fourth, even more severe rain event, the flow into the receiving tank 24 is sufficient to overflow the weirs 58, 60 and the overflow enters the storage chamber 26. The storage chamber 26 provides the ability to store and delay the discharge of such excess runoff. Water is discharged from the storage chamber 26 primarily through the discharge opening 82, but also discharges through the discharge opening 78 at low head as previously described. All the discharge openings are cooperatively sized to discharge water to the storm drain 22 at a flow rate not greater than the rate authorized by law or regulation.

Figure 12:
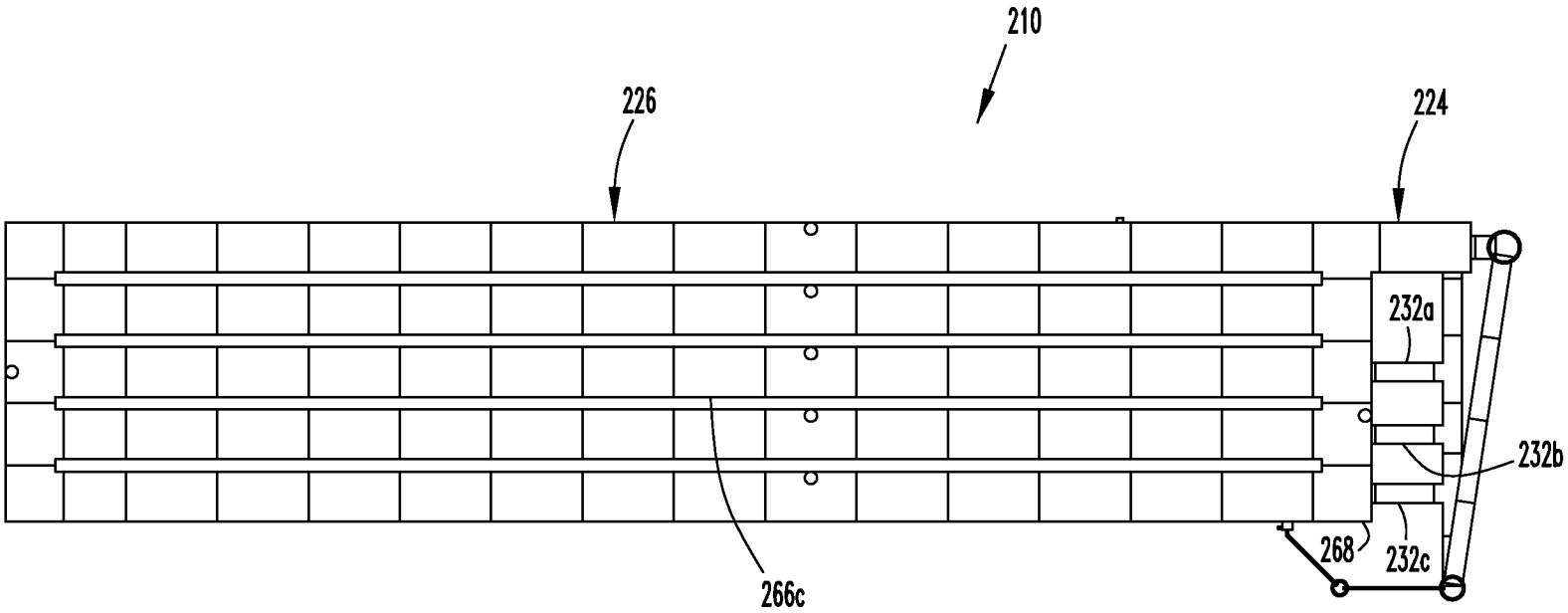
FIG. 12 is a top view similar to FIG. 1 of a second embodiment underground stormwater management system in accordance with the present invention.

FIG. 12 illustrates a second embodiment USMS 210 that includes a receiving tank 224 identical to the receiving tank 24 and a storage chamber 226 similar to storage chamber 226. Only the differences between storage chamber 26 and storage chamber 226 will be discussed, it being understood the other elements remain the same as previously described.

Figure 13:
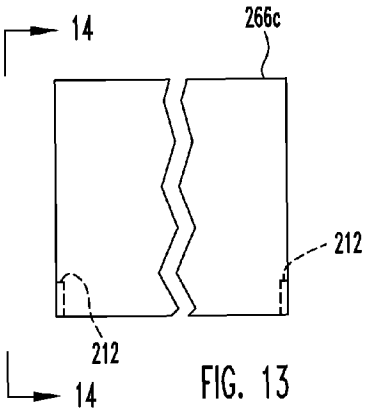
FIG. 13 is a side view of the perforated storage tank of the USMS shown in FIG. 12.
Figure 14:
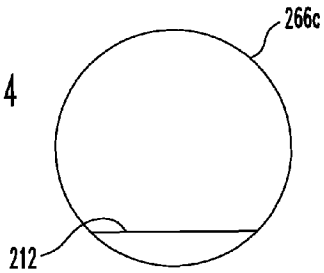
FIG. 14 is an end view of the perforated storage tank taken along lines 14-14 of FIG. 13.

USMS 210 includes a perforated storage tank 266*c* similar to perforated storage tank 66*c*. The open ends of the tank 266*c* are partially closed by weirs formed by respective weir plates 212. See FIGS. 13 and 14. The illustrated weir plates 212 each extends upwardly from the bottom of the storage tank to an upper edge located one foot, nine inches above the bottom of the storage tank.

Figure 15:
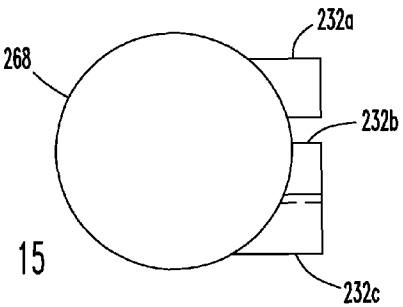
FIG. 15 is an end view of the front storage tank of the USMS shown in FIG. 12.

USMS 210 also replaces the single discharge 32 with multiple discharge pipes 232*a*, 232*b*, and 232*c* spaced along the length of the front storage tank 268. See FIGS. 12 and 15. The multiple discharge pipes 232 communicate with the main discharge pipe 228 through respective discharge openings or discharge orifices formed in the wall of the front storage tank 268. The number of discharge openings, their shapes, areas, and relative elevations can be varied as needed to meet discharge requirements at the site.

Operation of USMS 210 is similar to USMS 10. The weirs 212 obstruct the flow of first-flush into the ends of the perforated storage tank 266*c*, preventing first flush from entering the perforated storage tank 266*c* during the initial receipt of runoff into the USMS 210. This enables the storage chamber 226 to accumulate an additional volume of first flush without the first flush entering the perforated storage tank 266*c*, preventing first flush from being discharged directly into the porous media surrounding the tank 266*c*.

Preferably the bottom of the lowest of the discharge openings associated with the discharge pipes 232 is spaced at or above the top of the weirs 212. This way first flush received into the storage chamber 226 flows to the discharge 230 only through solid storage portion and is discharged from the storage tank 226 only through the discharge 230.

The multiple discharge openings 232 increase the number of active discharge openings discharging into the main discharge pipe 218 during major rain events. As the water level in the storage chamber 226 increases, the effective area of the discharge openings discharging into the pipe 218 increases. The number of discharge openings, their shapes and areas, and relative elevations can be varied as needed to meet discharge requirements for different year events at the site.

Storage chamber 226 has a perforated storage portion formed by tubular storage tank 266*c*, with the perforated storage portion arranged hydraulically in parallel with a portion of the solid storage portion of the storage chamber between the inlet and discharge of the storage chamber. This enables first-flush to flow from the inlet to the discharge only through the solid storage portion of the storage chamber 226 when the water level is below the top of the weirs 212.

Figure 16:
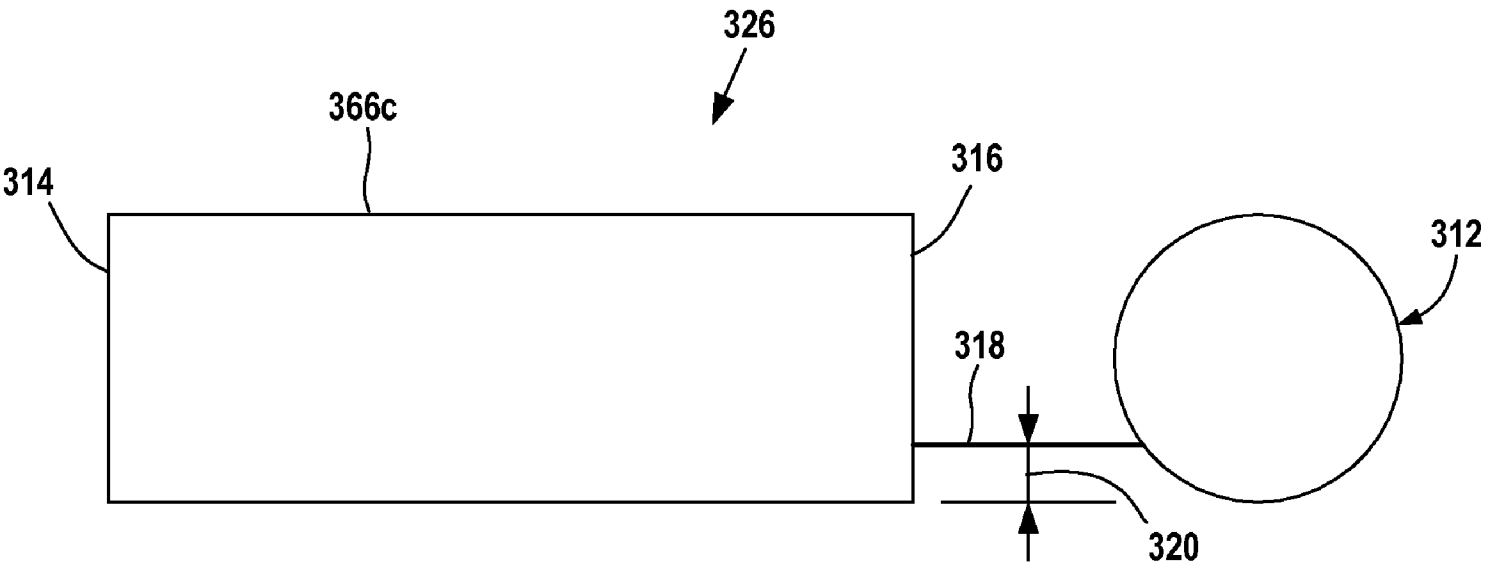
FIG. 16 is a schematic view of a third embodiment underground stormwater management system in accordance with the present invention.

FIG. 16 illustrates schematically a portion of a third embodiment storage chamber 326 similar to storage chamber 26. The storage chamber 326 includes a perforated storage tank 366*c* located to one side of a solid storage portion 312. The solid storage portion 312 defines a flow path extending between the inlets and discharges of the storage chamber 326 as previously described.

Bulkheads 314, 316 close the ends of the storage tank 366*c*. A flow conduit 318 fluidly connects one end of the storage tank 366*c* to the solid storage portion 312. The relative elevation 320 of the flow conduit 318 establishes the water level at which water flows from the solid storage portion into the perforated storage portion, and performs essentially the same function as the weirs 212 to prevent flow into the perforated storage portion and then to the surrounding media until the water level in the solid storage portion reaches a predetermined elevation.

In yet other embodiments the perforated storage portion could be placed at a higher elevation than the solid storage portion, the difference in elevation performing the same function as the weirs 212 in preventing flow into the perforated storage portion and then into the surrounding media until the water level in the solid storage portion reaches a predetermined elevation.

In still yet other embodiments only the lower portion of perforated pipe has a solid wall, and the upper portion of the perforated pipe has a perforated wall. The water level in the perforated pipe must reach the level of the perforated wall to pass through the pipe wall. The difference in elevation between solid and perforated wall portions performs the same function as the weirs 212 in preventing the flow into the perforated storage portion and into the surrounding media until the water level in the solid storage portion reaches a predetermined elevation. Other configurations are possible and could be adapted to meet site requirements.

It should be understood that while the illustrated underground storm management structures illustrated herein are fabricated primarily from large diameter pipe, equivalent structures can be fabricated using plates, box structures, and the like.

Furthermore in alternative embodiments the perforated storage portion of the storage chamber can be formed from different structures than the solid storage portion. For example, arch-shaped members having open floors can be used instead of perforated pipe in the perforated storage portion. An example of an arch-shaped member that can be adapted for use in the present invention is disclosed in Maestro U.S. Pat. No. 6,361,248.

The relative sizes of the receiving tank and storage tank, inlet and outlet locations and sizing, and other design parameters of the underground stormwater management system of the present invention can be modeled using hydraulic design software to meet site-specific design requirements.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. An underground stormwater management system to manage the flow of runoff to a stormwater drain, the system comprising:

a storage chamber defining an interior for receiving and discharging runoff, a receiving tank, a filter outside of the storage chamber, a first discharge line to flow runoff from the storage chamber to the stormwater drain, and a second discharge line to flow runoff from the storage chamber to the stormwater drain;

the storage chamber comprising a first inlet, a second inlet spaced from the first inlet, a first discharge outlet and a second discharge outlet, the first and second inlets to receive runoff into the interior of the storage chamber, the first inlet to be connected to a first source of stormwater runoff and the second inlet to be connected to second source of stormwater runoff, the first discharge outlet to discharge runoff from the interior of the storage chamber into the first discharge line, the second discharge outlet to discharge runoff from the interior of the storage volume into the second discharge line, the first discharge outlet at a first elevation and the second discharge outlet at a second, higher elevation than the first outlet, the first elevation corresponding to a first volume of runoff in the interior of the storage chamber and the second elevation corresponding to a second, greater volume of runoff in the interior of the storage chamber whereby the storage chamber must fill to at least the greater volume before reaching the second discharge outlet;

the receiving tank to be connected to the second source of stormwater runoff and comprising an overflow outlet and a discharge opening, the overflow outlet fluidly connected to the second inlet of the storage chamber, the tank discharge opening to be fluidly connected to the storm drain, the tank discharge opening located at a lower elevation than the overflow outlet whereby the receiving tank must fill to a predetermined volume before overflowing stormwater runoff to the storage chamber; and the filter in the first discharge line to filter runoff flowing through the first discharge line.

2. The underground stormwater management system of claim 1 wherein the first discharge outlet of the storage chamber is located at essentially the lowest elevation of the storage chamber.

3. The underground stormwater management system of claim 1 wherein the first discharge outlet of the storage chamber has a first cross-sectional area and the second outlet of the storage chamber has a second, larger cross-sectional area.

4. The underground stormwater management system of claim 1 wherein the second discharge outlet of the storage chamber comprises a plurality of discharge openings.

5. The underground stormwater management system of claim 4 wherein the discharge openings of the storage chamber's second discharge outlet are spaced apart in elevation from one another whereby the storage chamber must fill to successively greater volumes to reach the successively higher discharge openings of the second discharge outlet.

6. The underground stormwater management system of claim 1 wherein the storage chamber comprises a nonperforated portion and a perforated portion, the nonperforated portion of the storage chamber defining a fluid path fluidly connecting the first inlet of the storage chamber and the first discharge outlet of the storage chamber.

7. The underground stormwater management system of claim 6 wherein the perforated portion of the storage chamber drains directly into a permeable media.

8. The underground stormwater management system of claim 6 wherein the perforated portion of the storage chamber is separated from the nonperforated portion of the storage chamber by a weir having a height wherein stormwater runoff in the nonperforated portion of the storage chamber must rise to the height of the weir before overflowing into the perforated portion.

9. The underground stormwater management system of claim 6 wherein the nonperforated portion of the storage chamber comprises a first storage tank having a respective lowest elevation and the perforated portion of the storage chamber comprises a second storage tank, the first and second storage tanks fluidly connected by a conduit having an elevation higher than the lowest elevation of the first storage tank whereby stormwater runoff in the first storage tank must rise to the elevation of the conduit before overflowing into the second storage tank.

10. The underground stormwater management system of claim 6 wherein the perforated portion of the storage chamber is disposed at a higher elevation than the nonperforated portion of the storage chamber.

11. The underground stormwater management system of claim 6 wherein the perforated portion of the storage chamber includes an upper portion, a lower portion, and perforations located in only the upper portion whereby stormwater runoff in the perforated portion of the storage chamber must rise to a level above the lower portion to be discharged through the perforations.

12. An underground stormwater management system to manage the flow of runoff to a stormwater drain, the system comprising:

a storage chamber defining an interior for receiving and discharging runoff, a receiving tank, a first discharge line to flow runoff from the storage chamber to the stormwater drain, and a second discharge line to flow runoff from the storage chamber to the stormwater drain;

the storage chamber comprising a first inlet, a second inlet spaced from the first inlet, a first discharge outlet and a second discharge outlet, the first and second inlets to receive runoff into the interior of the storage chamber, the first inlet to be connected to a first source of stormwater runoff and the second inlet to be connected to second source of stormwater runoff, the first discharge outlet to discharge runoff from the interior of the storage chamber into the first discharge line, the second discharge outlet to discharge runoff from the interior of the storage volume into the second discharge line, the first discharge outlet at a first elevation and the second discharge outlet at a second, higher elevation than the first outlet, the first elevation corresponding to a first volume of runoff in the interior of the storage chamber and the second elevation corresponding to a second, greater volume of runoff in the interior of the storage chamber whereby the storage chamber must fill to at least the greater volume before reaching the second discharge outlet; and the receiving tank to be connected to the second source of stormwater runoff and comprising an overflow outlet and a discharge opening, the overflow outlet fluidly connected to the second inlet of the storage chamber, the tank discharge opening to be fluidly connected to the storm drain, the tank discharge opening located at a lower elevation than the overflow outlet whereby the receiving tank must fill to a predetermined volume before overflowing stormwater runoff to the storage chamber.

13. The underground stormwater management system of claim 12 wherein the first discharge outlet of the storage chamber is located at essentially the lowest elevation of the storage chamber.

14. The underground stormwater management system of claim 12 wherein the first discharge outlet of the storage chamber has a first cross-sectional area and the second outlet of the storage chamber has a second, larger cross-sectional area.

15. The underground stormwater management system of claim 12 wherein the second discharge outlet of the storage chamber comprises a plurality of discharge openings.

16. The underground stormwater management system of claim 15 wherein the discharge openings of the storage chamber's second discharge outlet are spaced apart in elevation from one another whereby the storage chamber must fill to successively greater volumes to reach the successively higher discharge openings of the second discharge outlet.

17. The underground stormwater management system of claim 12 wherein the storage chamber comprises a nonperforated portion and a perforated portion, the nonperforated portion of the storage chamber defining a fluid path fluidly connecting the first inlet of the storage chamber and the first discharge outlet of the storage chamber.

18. The underground stormwater management system of claim 17 wherein the perforated portion of the storage chamber drains directly into a permeable media.

19. The underground stormwater management system of claim 18 wherein the perforated portion of the storage chamber is separated from the nonperforated portion of the storage chamber by a weir having a height wherein stormwater runoff in the nonperforated portion of the storage chamber must rise to the height of the weir before overflowing into the perforated portion.

20. The underground stormwater management system of claim 17 wherein the nonperforated portion of the storage chamber comprises a first storage tank having a respective lowest elevation and the perforated portion of the storage chamber comprises a second storage tank, the first and second storage tanks fluidly connected by a conduit having an elevation higher than the lowest elevation of the first storage tank whereby stormwater runoff in the first storage tank must rise to the elevation of the conduit before overflowing into the second storage tank.

21. The underground stormwater management system of claim 17 wherein the perforated portion of the storage chamber is disposed at a higher elevation than the nonperforated portion of the storage chamber.

22. The underground stormwater management system of claim 17 wherein the perforated portion of the storage chamber includes an upper portion, a lower portion, and perforations located in only the upper portion whereby stormwater runoff in the perforated portion of the storage chamber must rise to a level above the lower portion to be discharged through the perforations.

23. A method of managing the stormwater runoff from a storm event to a stormwater drain, the method comprising the steps of:

(a) providing a storage chamber and a receiving tank to receive the runoff, the storage chamber comprising an inlet to receive runoff into the storage chamber and first and second discharge openings that each permit runoff to exit the storage chamber, the first discharge opening being the lowest elevation discharge opening in the storage chamber, the second discharge opening at a higher elevation than the first discharge opening, each discharge opening discharging to a respective flow path that flows runoff to the stormwater drain, the receiving tank comprising an inlet to receive runoff into the receiving tank, a discharge opening discharging to a flow path that flows runoff to the stormwater drain, and an overflow outlet fluidly connected to the storage chamber, the tank discharge opening at a lower elevation than the tank outlet opening;

(b) receiving a first volume of runoff through the storage chamber inlet and into the storage chamber when the storage chamber is initially empty;

(c) discharging the first volume of runoff received in the storage chamber through the first discharge opening while the water level in the storage chamber is below the second discharge opening and filtering the runoff discharged from the first discharge opening;

(d) receiving a second volume of runoff through the receiving tank inlet and into the receiving tank, the second volume of water sufficient to raise the water level in the receiving tank and discharging an overflow portion of the second volume of runoff through the receiving tank overflow outlet and into the storage chamber, the overflow portion sufficient to raise the water level in the storage chamber at or above the second discharge opening in the storage chamber; and (e) discharging the runoff in the storage chamber simultaneously through the first and second discharge openings of the storage chamber while the water level in the storage chamber is at or above the second discharge opening while simultaneously discharging the runoff in the receiving tank through the receiving tank discharge opening.

24. The method of claim 23 wherein the receiving tank begins receiving the second volume of runoff after the storage tank begins discharging the first volume of runoff from the storage tank.

25. The method of claim 23 wherein the first volume of runoff is completely discharged from the storage chamber prior to the receiving tank receiving the second volume of runoff.

26. The method of claim 23 wherein the second discharge opening of the storage tank comprises a plurality of second discharge openings spaced apart in elevation from one another, and step (d) comprises the step of:

(f) discharging an overflow portion of the second volume of runoff into the storage chamber sufficient to raise the water level in the storage chamber at or above all the plurality of second discharge openings of the storage chamber.

27. The method of claim 23 wherein the storage chamber comprises a perforated chamber portion and a nonperforated chamber portion, and comprising the step of:

(f) discharging a portion of the overflow portion of the second volume of runoff received in the storage chamber through the perforated chamber portion of the storage chamber.

28. The method of claim 23 wherein the perforated chamber portion is initially empty and step (f) comprises the step of:

(g) raising the water level in the nonperforated chamber portion to a first water level; and (h) flowing water into the empty perforated chamber portion only after the water level in the nonperforated chamber portion has reached the first water level.

* * * * *